US010190771B2

(12) United States Patent
Oda et al.

(10) Patent No.: US 10,190,771 B2
(45) Date of Patent: Jan. 29, 2019

(54) EXHAUST DUCT AND BOILER

(71) Applicant: MITSUBISHI HEAVY INDUSTRIES, LTD., Tokyo (JP)

(72) Inventors: Manabu Oda, Tokyo (JP); Shimpei Todaka, Tokyo (JP); Kiyonori Kushioka, Tokyo (JP); Masashi Kiyosawa, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 454 days.

(21) Appl. No.: 15/100,100

(22) PCT Filed: Nov. 27, 2014

(86) PCT No.: PCT/JP2014/081310
§ 371 (c)(1),
(2) Date: May 27, 2016

(87) PCT Pub. No.: WO2015/098411
PCT Pub. Date: Jul. 2, 2015

(65) Prior Publication Data

US 2017/0038066 A1 Feb. 9, 2017

(30) Foreign Application Priority Data

Dec. 25, 2013 (JP) ..... 2013-267997

(51) Int. Cl.
*F23J 15/02* (2006.01)

(52) U.S. Cl.
CPC ..... *F23J 15/022* (2013.01); *F23J 2217/20* (2013.01)

(58) Field of Classification Search
CPC ..... F23J 15/022; F23J 2217/20
See application file for complete search history.

(56) References Cited

U.S. PATENT DOCUMENTS 2,244,936 A * 6/1941 Bird ..... F23J 15/022 126/280
3,503,348 A * 3/1970 Dvirka ..... F23J 15/022 110/216

(Continued)

FOREIGN PATENT DOCUMENTS

JP 49-126185 12/1974
JP 52-137330 4/1976

(Continued)

OTHER PUBLICATIONS

Notice of Allowance dated Jan. 26, 2017 in corresponding Taiwanese Application No. 103141423 (with English translation).

(Continued)

*Primary Examiner* — David J Laux
(74) *Attorney, Agent, or Firm* — Wenderoth, Lind & Ponack, L.L.P.

(57) ABSTRACT

An exhaust duct and boiler can appropriately collect solid particles in flue gas by way of being provided with: a flue (40) in which flue gas can flow; a first hopper (61) that is provided in the flue (40) and that can collect solid particles (PA) in the flue gas; and a first baffle plate (71) and a second baffle plate (72) that are resisting members capable of blocking the flow of solid particles (PA) from the first hopper (61).

5 Claims, 6 Drawing Sheets

(56) References Cited

U.S. PATENT DOCUMENTS

| | | | | |
|---|---|---|---|---|
| 3,656,440 | A * | 4/1972 | Grey | B03C 3/15 110/119 |
| 4,285,282 | A * | 8/1981 | Good | F23G 5/16 110/216 |
| 6,994,036 | B2 | 2/2006 | Grommes et al. | |
| 2008/0028935 | A1 | 2/2008 | Andersson | |

FOREIGN PATENT DOCUMENTS

| | | |
|---|---|---|
| JP | 53-141942 | 12/1978 |
| JP | 1-129548 | 9/1989 |
| JP | 2-95415 | 4/1990 |
| JP | 3-14549 | 2/1991 |
| JP | 5-25134 | 4/1993 |
| JP | 2724176 | 3/1998 |
| JP | 10-165734 | 6/1998 |
| JP | 2002-138284 | 5/2002 |
| JP | 2002-210315 | 7/2002 |
| JP | 2008-241061 | 10/2008 |
| JP | 2011-161385 | 8/2011 |

OTHER PUBLICATIONS

Written Opinion of the International Searching Authority dated Feb. 24, 2015 in corresponding International Application No. PCT/JP2014/081310.

Decision of a Patent Grant dated Jun. 14, 2016 in corresponding Japanese Application No. 2013-267997 (with English translation).

International Search Report dated Feb. 24, 2015 in corresponding International Application No. PCT/JP2014/081310.

* cited by examiner

EXHAUST DUCT AND BOILER

TECHNICAL FIELD

The present invention relates to an exhaust duct which is applied to a boiler which generates steam for power generation, a factory, or the like, and a boiler including the exhaust duct.

BACKGROUND ART

For example, in the related art, a pulverized coal burning boiler includes a furnace which has a hollow shape and is installed in a vertical direction, and a plurality of combustion burners are disposed on a wall of the furnace along a circumferential direction and are arranged in a plurality of stages in an upward-downward direction. A gaseous mixture of pulverized coal (fuel) which is crushed coal and transport air (primary air) is supplied to the combustion burner, high-temperature secondary air is supplied to the combustion burner, flames are generated by blowing the gaseous mixture and the secondary gas into the furnace, and combustion gas can be generated in the furnace. In addition, a flue is connected to the upper portion of the furnace, a superheater, a reheater, an economizer, or the like for collecting heat of flue gas is provided in the flue, water is heated by exhaust gas generated by combustion in the furnace, and steam can be generated. In addition, a flue gas passage is connected to the flue, a denitration device, an electric dust collector, a desulfurization device, or the like is provided in the flue gas passage, and a chimney is provided on a downstream end portion of the flue gas passage.

For example, as the boiler, there are boilers which are disclosed in PTLs below.

CITATION LIST

Patent Literature

[PTL 1] Specification of U.S. Pat. No. 6,994,036

[PTL 2] Japanese Unexamined Patent Application Publication No. 2-95415

[PTL 3] Japanese Unexamined Patent Application Publication No. 2008-241061

SUMMARY OF INVENTION

Technical Problem

In the above-described pulverized coal burning boiler, since pulverized coal which is a fuel is combusted in a furnace, popcorn ash (massive ash) is mixed into the flue gas. Since the popcorn ash is lumps of ash, particularly, the popcorn ash adheres to a screen, a denitration device, or the like provided in a flue gas passage. Accordingly, the screen is abraded and needs to be exchanged, and a maintenance cost increases. In addition, the popcorn ash is accumulated on the screen or the denitration device, pressure loss increases, and performance decreases.

The present invention is made to solve the above-described problem, and an object thereof is to provide an exhaust duct and a boiler capable of appropriately collecting solid particles in flue gas.

Solution to Problem

In order to achieve the object, according to an aspect of the present invention, there is provided an exhaust duct, including: a flue gas passage in which flue gas can flow; a hopper which is provided in the flue gas passage and can collect solid particles in the flue gas; and resisting members which can block outflow of the solid particles from the hopper.

Accordingly, when the flue gas containing the solid particles flows through the flue gas passage, the solid particles are separated from the flue gas and are collected in the hopper. At this time, since the solid particles have an inertia force, the solid particles collide with an inner wall surface of the hopper and easily flow out to the outside. However, since the solid particles flowing out to the outside collide with the resisting members, outflow of the solid particles is blocked. As a result, it is possible to appropriately collect the solid particles in the flue gas in the hopper, and it is possible to improve collection efficiency.

In the exhaust duct of the present invention, the resisting members may include a baffle plate which is disposed on an upper portion of the hopper along a horizontal direction intersecting a flow direction of the flue gas.

Accordingly, since the baffle plate is disposed along the horizontal direction intersecting the flow direction of the flue gas, it is possible to appropriately collect the solid particles flowing through the entire region of the exhaust duct in the hopper.

In the exhaust duct of the present invention, the baffle plate may include a first baffle plate which is disposed on the upper portion of the hopper and a downstream side end portion in the flow direction of the flue gas.

Accordingly, after the solid particles separated from the flue gas enter the hopper, the solid particles collide with the inner wall surface and flow out to the outside. However, since the solid particles flowing out to the outside collide with the first baffle plate which is disposed on the downstream side end portion in the flow direction of the flue gas, it is possible to effectively block outflow of the solid particles.

In the exhaust duct of the present invention, a collision surface of the first baffle plate with respect to the solid particles facing the flow direction of the flue gas may be disposed so as to be toward a bottom portion side of the hopper.

Accordingly, since the collision surface of the first baffle plate is toward the bottom portion side of the hopper, after the solid particles flowing out to the outside collide with the collision surface, the solid particles are introduced to the bottom portion side of the hopper, and it is possible to effectively collect the solid particles.

In the exhaust duct of the present invention, the baffle plate may include a second baffle plate which is disposed on the upper portion of the hopper and at an intermediate position in the flow direction of the flue gas.

Accordingly, the solid particles separated from the flue gas are introduced into the hopper while moving along the inner wall surface of the flue gas passage, collide with the inner wall surface of the hopper, and flow out to the outside. However, since the solid particles introduced into the hopper collide with the second baffle plate which is disposed at the intermediate position in the flow direction of the flue gas, it is possible to effectively collect the solid particles in the hopper and to block outflow of the solid particles.

In the exhaust duct of the present invention, the second baffle plate may be disposed such that a lower end portion in a vertical direction is inclined toward the downstream side in the flow direction of the flue gas.

Accordingly, since the second baffle plate is inclined, after the solid particles introduced into the hopper collide with the second baffle plate, the solid particles are introduced into the bottom portion side of the hopper, and it is possible to effectively collect the solid particles.

In the exhaust duct of the present invention, the hopper may be formed so as to be concaved from the flue gas passage toward the lower side in the vertical direction, and the resisting members may be disposed so as not to protrude toward the flue gas passage in the hopper.

Accordingly, since the resisting members are disposed inside the hopper, the resisting members do not interrupt the flow of the flue gas in the flue gas passage, and it is possible to appropriately separate the solid particles from the flue gas such that they are collected in the hopper.

In the exhaust duct of the present invention, a low repulsion portion having a lower repulsion coefficient than that of an inner wall surface of the flue gas passage is provided on an upstream side or a downstream side of the hopper in the flow direction of the flue gas.

Accordingly, after the solid particles included in the flue gas collide with the low repulsion portion, since repulsion amounts of the solid particles decrease, it is possible to appropriately collect the solid particles in the hopper. In this case, if the low repulsion portion is positioned on the upstream side in the flow direction of the flue gas in the hopper, since the solid particles collide with the low repulsion portion before the hopper, inertia forces of the solid particles decrease, and the solid particles easily enter the hopper. Accordingly, amounts of the solid particles which jump over the hopper, are scattered into the downstream side, and flow out decrease. Moreover, if the low repulsion portion is positioned on the downstream side in the flow direction of the flue gas in the hopper, since the solid particles collide with the low repulsion portion after the solid particles pass through the upper portion of the hopper, inertia forces of the solid particles decrease, and the solid particles easily enter the hopper. Accordingly, amounts of the solid particles which jump over the hopper, are scattered into the downstream side, and flow out decrease.

In addition, according to another aspect of the present invention, there is provided a boiler including: a furnace which has a hollow shape and is provided along a vertical direction; a combustion device which blows a fuel toward the inner portion of the furnace and combusts the fuel; the exhaust duct which is connected to a downstream side in a flow direction of a flue gas in the furnace; and a heat collection portion which is provided in the exhaust duct and can collect heat in the flue gas.

Accordingly, flames are formed by blowing the fuel into the furnace with the combustion device, the generated combustion gas flows into the exhaust duct, and the solid particles are separated from the flue gas so as to be collected in the hopper while the heat in the flue gas is collected by the heat collection portion. At this time, since the solid particles have an inertia force, the solid particles collide with the inner wall surface of the hopper and easily flow out to the outside. However, since the solid particles flowing out to the outside collide with the resisting members, outflow of the solid particles is blocked. As a result, it is possible to appropriately collect the solid particles in the flue gas in the hopper, and it is possible to improve collection efficiency.

Advantageous Effects of Invention

According to the exhaust duct and the boiler of the present invention, since the resisting members capable of blocking outflow of the solid particles are provided in the hopper in the flue gas passage, it is possible to appropriately collect the solid particles in the flue gas in the hopper, and it is possible to improve collection efficiency.

DESCRIPTION OF EMBODIMENTS

Hereinafter, preferred embodiments of an exhaust duct and a boiler of the present invention will be described in detail with reference to the accompanying drawings. In addition, the present invention is not limited by the embodiments, and in a case where there are the plurality of embodiments, the present invention also includes combination of the embodiments.

[First Embodiment]

Figure 1:
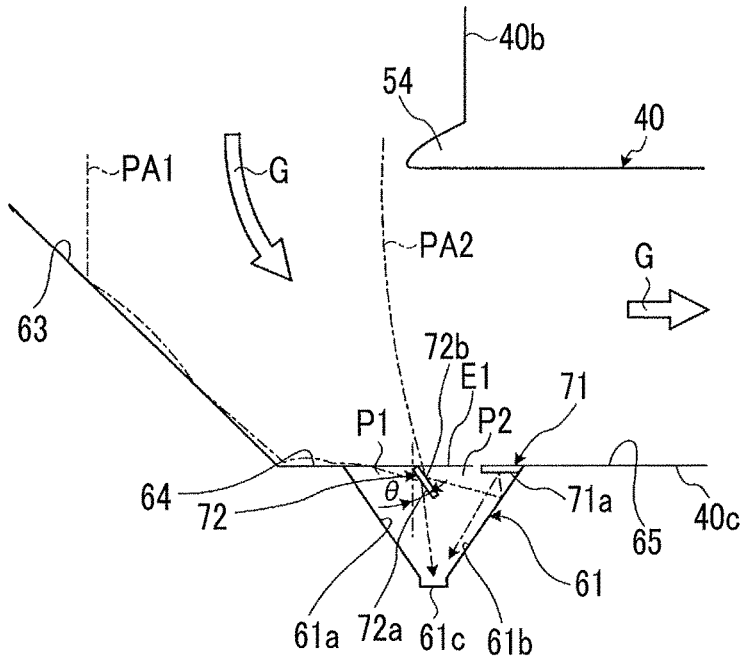
FIG. 1 is a side view showing an exhaust duct of a first embodiment.
Figure 2:
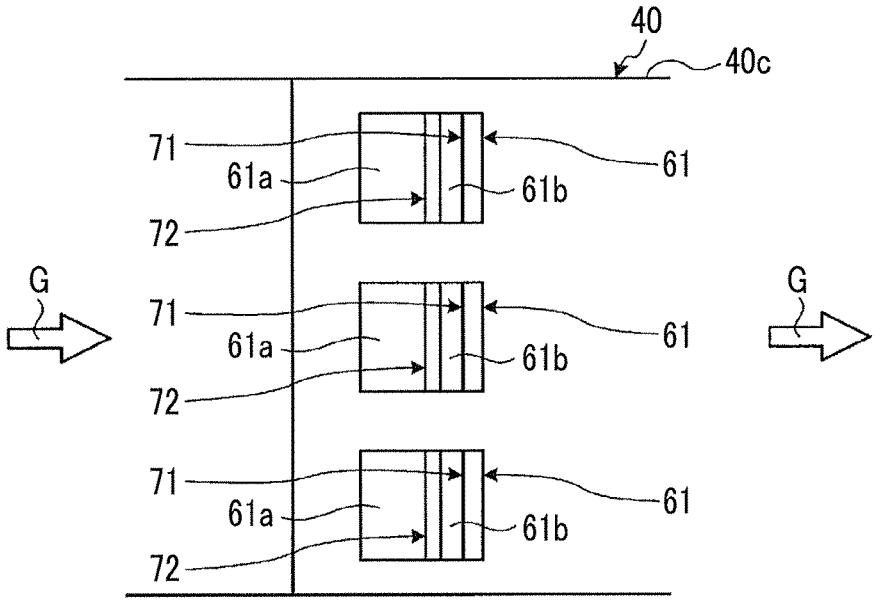
FIG. 2 is a plan view showing the exhaust duct of the first embodiment.
Figure 3:
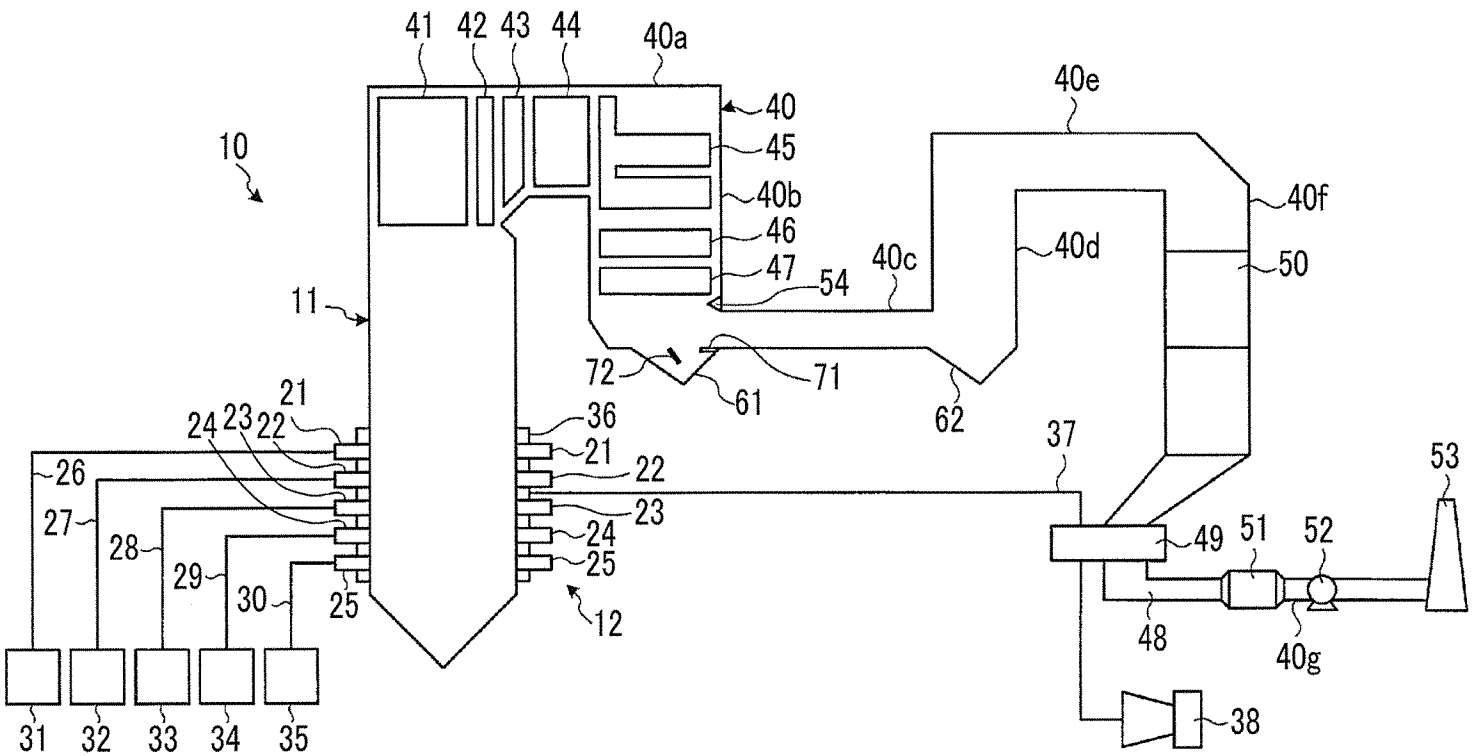
FIG. 3 is a schematic configuration view showing a pulverized coal burning boiler to which the exhaust duct of the first embodiment is applied.

FIG. 1 is a side view showing an exhaust duct of a first embodiment, FIG. 2 is a plan view showing the exhaust duct of the first embodiment, and FIG. 3 is a schematic configuration view showing a pulverized coal burning boiler to which the exhaust duct of the first embodiment is applied.

The pulverized coal burning boiler to which the exhaust duct of the first embodiment is applied is a boiler in which pulverized coal which is crushed coal is used as a solid fuel, the pulverized coal is combusted by a combustion burner, and heat generated by the combustion can be collected. In addition, here, the case where the pulverized coal burning boiler is applied is described. However, in the present invention, the boiler is not limited to the pulverized coal burning boiler, and the fuel is not limited to the coal.

In the first embodiment, as shown in FIG. 3, a pulverized coal burning boiler 10 is a conventional boiler, and includes a furnace 11 and a combustion device 12. The furnace 11 has a square cylindrical hollow shape and is installed along a vertical direction, and the combustion device 12 is provided on a lower portion of a furnace wall configuring the furnace 11.

The combustion device 12 includes a plurality of combustion burners 21, 22, 23, 24, and 25 which are mounted on the furnace wall. In the present embodiment, in the combustion burners 21, 22, 23, 24, and 25, four burners which are arranged with equal intervals therebetween in a circumferential direction are set to one set, and five sets of burners, that is, five stages of burners are disposed in the vertical direction.

In addition, each of the combustion burners 21, 22, 23, 24, and 25 is connected to each of coal pulverizers (mills) 31, 32, 33, 34, and 35 via each of pulverized coal supply pipes 26, 27, 28, 29, and 30. In each of the coal pulverizers 31, 32, 33, 34, and 35, although it is not shown, a crushing table is supported so as to be driven and rotated around a rotational axis along a vertical direction in a housing, and a plurality of crushing rollers facing the upper portion of the crushing table are rotatably supported so as to interlock with the rotation of the crushing table. Accordingly, if coal is input to a portion between the plurality of crushing rollers and the crushing table, here, the coal is crushed so as to be a predetermined size, and it is possible to supply pulverized coal classified by a transport air (primary air) from the pulverized coal supply pipes 26, 27, 28, 29, and 30 to the combustion burners 21, 22, 23, 24, and 25.

Moreover, in the furnace 11, a wind box 36 is provided on the mounting position of each of the combustion burners 21, 22, 23, 24, and 25, one end portion of an air duct 37 is connected to the wind box 36, and a blower 38 is mounted on the other end portion of the air duct 37. Accordingly, combustion air (secondary air and tertiary air) fed by the blower 38 is supplied from the air duct 37 to the wind box 36, and the combustion air can be supplied from the wind box 36 to each of the combustion burners 21, 22, 23, 24, and 25.

Therefore, in the combustion device 12, each of the combustion burners 21, 22, 23, 24, and 25 can blow a pulverized fuel-gas mixture (fuel gas), in which the pulverized coal and the primary air are mixed with each other, into the furnace 11, can blow the secondary air into the furnace 11, and can form flames by igniting the pulverized fuel-gas mixture using an ignition torch (not shown).

Moreover, in general, when the boiler starts, each of the combustion burners 21, 22, 23, 24, and 25 forms flames by injecting fuel oil into the furnace 11.

A flue 40 is connected to the upper portion of furnace 11, and superheaters 41 and 42 for collecting the heat of the flue gas, reheaters 43 and 44, and economizers 45, 46, and 47 which are convection heat transfer portions (heat collection portions) are provided in the flue 40, and heat exchange is performed between the flue gas generated by the combustion of the furnace 11 and water.

A flue gas pipe (flue gas passage) 48 through which the flue gas subjected to the heat exchange is discharged is connected to the downstream side of the flue 40. An air heater 49 is provided between the flue gas pipe 48 and the air duct 37, heat exchange between air flowing through the air duct 37 and the flue gas flowing through the flue gas pipe 48 is performed, and it is possible to increase temperature of the combustion air supplied to the combustion burners 21, 22, 23, 24, and 25.

In addition, in the flue gas pipe 48, a selective reduction type catalyst 50 is provided at the position on the upstream side of the air heater 49, an ash dust processing device (electric dust collector, desulfurization device) 51 and an induced blower 52 are provided at the position on the downstream side of the air heater 49, and a chimney 53 is provided on the downstream end portion of the flue gas pipe 48. Here, the selective reduction type catalyst 50 and the electric ash dust processing device 51 function as a harmful matter removing portion.

Accordingly, if the coal pulverizers 31, 32, 33, 34, and 35 are driven, the produced pulverized coal is supplied to the combustion burners 21, 22, 23, 24, and 25 through the pulverized coal supply pipes 26, 27, 28, 29, and 30 along with the transport air. In addition, the heated combustion air is supplied from the air duct 37 to each of the combustion burners 21, 22, 23, 24, and 25 via the wind box 36. Accordingly, the combustion burners 21, 22, 23, 24, and 25 blow the pulverized fuel-gas mixture, in which the pulverized coal and the transport air are mixed with each other, into the furnace 11 and blow the combustion air into the furnace 11, and at this time, it is possible to form flames by performing ignition. In the furnace 11, the pulverized fuel-gas mixture and the combustion air are combusted, flames are generated, and if flames are generated at the lower portion inside the furnace 11, the combustion gas (flue gas) rises in the furnace 11 and is discharged to the flue 40.

In addition, in the furnace 11, since a supply amount of air is set so as to be less than a theoretical air amount with respect to a supply amount of the pulverized coal, a reduction atmosphere is maintained in the inner portion of the furnace 11. In addition, NOx generated by the combustion of the pulverized coal is reduced in the furnace 11, and thereafter, oxidation combustion of the pulverized coal is completed by additionally supplying additional air, and the generation amount of NOx is decreased by the combustion of the pulverized coal.

At this time, after water supplied from a water supply pump (not shown) is preheated by the economizers 45, 46, and 47, the water is supplied to a steam drum (not shown) and is heated so as to be saturated steam while being supplied to the water pipes (not shown) of the furnace wall, and the saturated steam is transported to a steam drum (not shown). Moreover, the saturated steam of the steam drum (not shown) is introduced into the superheaters 41 and 42 so as to be superheated by the combustion gas. The superheated steam generated by the superheaters 41 and 42 is supplied to a power generation plant (not shown) (for example, a turbine or the like). Moreover, the steam, which is extracted in the middle of an expansion process in the turbine, is introduced into the reheaters 43 and 44, is superheated again, and is returned to the turbine. In addition, the drum (steam drum) type furnace 11 is described. However, the present invention is not limited to this structure.

Thereafter, harmful materials such as NOx of the flue gas passing through the economizers 45, 46, and 47 of the flue 40 are removed by the selective reduction type catalyst 50 in the flue gas pipe 48, particle materials and the sulfur contents are removed by the ash dust processing device 51, and thereafter, the flue gas is discharged from the chimney 53 to the atmosphere.

In the pulverized coal burning boiler 10 described as above, the downstream side (flue 40) of the furnace 11 functions as the exhaust duct of the first embodiment. In addition, in the flue 40, a first horizontal flue portion 40*a*, a first vertical flue portion 40*b*, a second horizontal flue portion 40*c*, a second vertical flue portion 40*d*, a third horizontal flue portion 40*e*, a third vertical flue portion 40*f*, and a fourth horizontal flue portion 40*g* are continuously provided. In addition, a kicker 54 is provided on the inner side of a continuous portion between the first vertical flue portion 40*b* and the second horizontal flue portion 40*c* in the horizontal direction.

In addition, in the flue 40, the superheaters 41 and 42, the reheaters 43 and 44, and the economizers 45, 46, and 47 are disposed in the first horizontal flue portion 40*a* and the first vertical flue portion 40*b*. In addition, in the flue 40, a first hopper 61 is installed on the lower end portion of the first vertical flue portion 40*b* through which the flue gas having a downward velocity component flows, and a second hopper 62 is installed on the lower end portion of the second vertical flue portion 40*d* through which the flue gas having an upward velocity component flows. In addition, in the flue 40, a selective reduction type catalyst 50 is installed in the third vertical flue portion 40*f* through which the flue gas flows downward.

The exhaust duct of the first embodiment includes the flue (flue gas passage) 40 in which the flue gas can flow, the first hopper 61 which is provided in the flue 40 and can collect solid particles (PA) in the flue gas, and resisting members which can block outflow of the PA from the first hopper 61. In the present embodiment, as the resisting members, a first baffle plate 71 and a second baffle plate 72 are provided.

In the exhaust duct of the first embodiment, as shown in FIGS. 1 and 2, the first hopper 61 mainly collects and stores popcorn ash (hereinafter, referred to as PA) which is large-diameter ash in the solid particles included in the flue gas. A plurality of first hoppers 61 (three in the present embodiment) are provided on the bottom portion of the upstream side of the flow direction of the flue gas in the second horizontal flue portion 40*c* with predetermined intervals therebetween in a width direction of the second horizontal flue portion 40*c*. In addition, the first hoppers 61 have the same shape as each other.

The first hopper 61 includes a first inclined surface 61*a* and a second inclined surface 61*b* which face each other in the flow direction of the flue gas such that an area of the first hopper 61 decreases downward, and a storage portion 61*c* is provided on a bottom position at which the lower end portions of the inclined surfaces 61*a* and 61*b* are connected to each other. In addition, in the first hopper 61, an opening portion which can be opened and closed by an on-off valve (not shown) is provided in the storage portion 61*c*, and the stored PA can be discharged downward by opening the opening portion.

In addition, in the flue 40, the first hopper 61 is provided in the second horizontal flue portion 40*c*, an inclined inner wall surface 63 and a first horizontal inner wall surface 64 are continuously provided on the upstream side of the first hopper 61 in the flow direction of the flue gas, and a second horizontal inner wall surface 65 is provided on the downstream side of the first hopper 61 in the flow direction of the flue gas. The inclined inner wall surface 63 is set so as to be equal to or more than a repose angle such that the PA can fall. In addition, the first horizontal inner wall surface 64 is continuous to the first inclined surface 61*a*, and the second horizontal inner wall surface 65 is continuous to the second inclined surface 61*b*.

The first baffle plate 71 and the second baffle plate 72 are disposed on the upper portion of the first hopper 61 along a horizontal direction (a direction vertical to a paper surface of FIG. 1, an upward-downward direction on a paper surface of FIG. 2) intersecting the flow direction of the flue gas. In the present embodiment, the first hopper 61 is formed so as to be concaved downward in the vertical direction from the bottom surface of the second horizontal flue portion 40*c*, and each of the baffle plates 71 and 72 is disposed so as not protrude toward the flue gas passage in the second horizontal flue portion 40*c* inside the first hopper 61.

The first baffle plate 71 is disposed on the upper portion of the first hopper 61 and on the downstream side end portion in the flow direction of the flue gas. The first baffle plate 71 is fixed to the first hopper 61 so as to be horizontal downward along an upper opening edge E1 of the first hopper 61. The first baffle plate 71 has a flat plate shape having a predetermined width and a predetermined length, and the width of the first baffle plate 71 is set so as to have the same as the width of the opening edge E1 of the first hopper 61. That is, the first baffle plate 71 closes the downstream side end portion of the opening of the first hopper 61 in the flow direction of the flue gas by a predetermined length. Moreover, in the first baffle plate 71, a collision surface 71*a* with respect to the solid particles is formed so as to face the flow direction of the flue gas, and the collision surface 71*a* faces the bottom portion (storage portion 61*c*) side of the first hopper 61.

The second baffle plate 72 is disposed on the upper portion of the first hopper 61 and at the intermediate position in the flow direction of the flue gas. The second baffle plate 72 is fixed so as to be inclined downward by a predetermined angle in the vicinity of the upper opening edge E1 of the first hopper 61. Specifically, the second baffle plate 72 is disposed such that the lower end portion in the vertical direction is inclined by a predetermined angle θ toward the downstream side in the flow direction of the flue gas. The second baffle plate 72 has a flat plate shape having a predetermined width and a predetermined length, and the width of the second baffle plate 72 is set so as to have the same as the width of the opening edge E1 of the first hopper 61. That is, the second baffle plate 72 closes the intermediate position of the opening of the first hopper 61 in the flow direction of the flue gas by a predetermined length. Moreover, in the second baffle plate 72, a first collision surface 72*a* with respect to the solid particles is formed so as to face the flow direction of the flue gas, and the first collision surface 72*a* faces the bottom portion (first inclined surface 61*a*) side of the first hopper 61. In addition, in the second baffle plate 72, a second collision surface 72*b* with respect to the solid particles which does not face the flow direction of the flue gas is formed, and the second collision surface 72*b* faces the downstream side in the flow direction of the flue gas on the upper portion of the first hopper 61.

Accordingly, in the first hopper 61, a first opening portion P1 is formed between the first horizontal inner wall surface 64 and the second baffle plate 72, and a second opening portion P2 is formed between the second baffle plate 72 and the first baffle plate 71.

Here, effects of the exhaust gas of the first embodiment will be described.

After heat of flue gas G is collected by the heat collection portion (superheaters 41 and 42, reheaters 43 and 44, and economizers 45, 46, and 47) of the flue 40, the flue gas moves downward along the first vertical flue portion 40*b*, is curved so as to be approximately perpendicular to the first vertical flue portion 40*b*, and flows into the second horizontal flue portion 40*c*. At this time, the PA contained in the flue gas G freely falls so as to be stored in the first hopper 61.

For example, PA1 falling along the inclined inner wall surface 63 enters the first hopper 61 from the first horizontal inner wall surface 64 and is collected in the first hopper 61. At this time, kinetic energy is applied to the PA1 from the flue gas, and the PA1 enters the first hopper 61 at a predetermined speed due to an inertia force (centrifugal force). Accordingly, the PA1 entering the first hopper 61 collides with the inclined surfaces 61*a* and 61*b*, and there is a concern that the PA1 may be out of the first hopper 61 due to a repulsion force. However, in the present embodiment, this second baffle plate 72 is provided. Accordingly, when the PA1 enters the first hopper 61, the PA1 collides with the first collision surface 72*a* of the second baffle plate 72 and moves to the storage portion 61*c* side so as to be collected, and outflow of the PA1 from the first hopper 61 is blocked.

In addition, PA2 falling from the first vertical flue portion 40*b* along with the flue gas G directly enters the first hopper 61 so as to be collected. At this time, since the PA2 enters the first hopper 61 at a predetermined speed, the PA2 entering the first hopper 61 collides with each of the inclined surfaces 61*a* and 61*b*, and there is a concern that the PA2 may be out of the first hopper 61 due to a repulsion force. However, in the present embodiment, since the first baffle plate 71 and the second baffle plate 72 are provided, when the PA2 enters the first hopper 61, the PA2 collides with the second collision surface 72*b* of the second baffle plate 72, moves to the second inclined surface 61*b* side, collides with the second inclined surface 61*b*, and thereafter, is discharged to the outside. However, since the PA2 collides with the collision surface 71*a* of the first baffle plate 71 and moves to the storage portion 61*c* side so as be collected, outflow of the PA2 from the first hopper 61 is blocked.

In addition, in a case where the PA2 falling from the first vertical flue portion 40*b* along with the flue gas directly enters the first hopper 61 from the opening portions P1 and P2 without colliding with the second collision surface 72*b* of the second baffle plate 72, the PA2 collides with each of the inclined surfaces 61*a* and 61*b*, and there is a concern that the PA2 may be out of the first hopper 61 due to the repulsion force. However, even though the PA2 directly enters the first hopper 61, collides with each of the inclined surfaces 61*a* and 61*b*, and is rebounded, since the PA2 collides with each of the collision surfaces 71*a* and 72*a* of the baffle plates 71 and 72 and moves to the storage portion 61*c* side so as to be collected, and the outflow of the PA2 from the first hopper 61 is blocked.

In this way, in the exhaust duct of the first embodiment, the flue 40 in which the flue gas can flow, the first hopper 61 which is provided in the flue 40 and can collect solid particles (PA) in the flue gas, and the first baffle plate 71 and the second baffle plate 72 which are the resisting members which can block outflow of the PA from the first hopper 61 are provided.

Accordingly, when the flue gas G containing the PA flows through the flue 40, the PA is separated from the flue gas G so as to be collected in the first hopper 61. At this time, since the PA has an inertial force, the PA collides with the inclined surfaces 61*a* and 61*b* of the first hopper 61, is repelled, and easily flows out. However, since the PA flowing to the outside collides with the first baffle plate 71 or the second baffle plate 72, outflow of the PA is blocked. As a result, it is possible to appropriately collect the PA in the flue gas G in the first hopper 61, and it is possible to improve collection efficiency of the PA.

In the exhaust duct of the first embodiment, the first baffle plate 71 and the second baffle plate 72 are disposed on the upper portion of the first hopper 61 along the horizontal direction intersecting the flow direction of the flue gas G. Accordingly, it is possible to appropriately collect the PA flowing through the entire region in the width direction of the flue 40 in the first hopper 61.

In the exhaust duct of the first embodiment, the first baffle plate 71 is disposed on the upper portion of the first hopper 61 and the downstream side end portion in the flow direction of the flue gas G. Accordingly, after the PA separated from the flue gas G enters the first hopper 61, the PA collides with the inclined surfaces 61*a* and 61*b* and flows out to the outside. However, since the PA flowing out to the outside collides with the first baffle plate 71 which is disposed on the downstream side end portion in the flow direction of the flue gas G, it is possible to effectively block outflow of the PA.

In the exhaust duct of the first embodiment, the collision surface 71*a* of the first baffle plate 71 with respect to the PA facing the flow direction of the flue gas G is disposed so as to be toward the storage portion 61*c* side of the first hopper 61. Accordingly, after the PA flowing out to the outside collide with the collision surface 71*a*, the solid particles are introduced to the storage portion 61*c* of the first hopper 61, and it is possible to effectively collect the PA.

In the exhaust duct of the first embodiment, the second baffle plate 72 disposed on the upper portion of the first hopper 61 and at an intermediate position in the flow direction of the flue gas G. Accordingly, the PA separated from the flue gas G is introduced into the first hopper 61 while moving along the inclined inner wall surface 63 of the flue 40, collides with inclined surfaces 61*a* and 61*b* of the first hopper 61, and flows out to the outside. However, since the PA introduced into the first hopper 61 collides with the second baffle plate 72 which is disposed at the intermediate position in the flow direction of the flue gas G, it is possible to effectively collect the PA in the first hopper 61 and to block outflow of the PA.

In the exhaust duct of the first embodiment, the second baffle plate 72 is disposed such that the lower end portion in a vertical direction is inclined toward the downstream side in the flow direction of the flue gas G. Accordingly, after the PA introduced into the first hopper 61 collides with the second baffle plate 72, the PA is introduced into the storage portion 61*c* of the first hopper 61, and it is possible to effectively to collect the PA.

In the exhaust duct of the first embodiment, the first baffle plate 71 and the second baffle plate 72 are disposed so as not to protrude toward the flue 40 in the first hopper 61. Accordingly, the first baffle plate 71 and the second baffle plate 72 do not interrupt the flow of the flue gas G in the flue 40, and it is possible to appropriately separate the PA from the flue gas G to be collected in the first hopper 61.

Moreover, in the boiler of the first embodiment, the furnace 11 which has a hollow shape and is provided along the vertical direction, a combustion device 12 which blows the fuel gas toward the inner portion of the furnace 11 and combusts the fuel gas, the exhaust duct which is connected to a downstream side in the flow direction of the flue gas in the furnace 11, and the heat collection portion (superheaters 41 and 42, reheaters 43 and 44, and economizers 45, 46, and 47) which is provided in the exhaust duct and can collect heat in the flue gas are provided.

Accordingly, flames are formed by blowing the fuel gas into the furnace 11 with the combustion device 12, the generated combustion gas flows into the exhaust duct, and the PA is separated from the flue gas G so as to be collected in the first hopper 61 while the heat in the flue gas is collected by the heat collection portion. At this time, since the PA has an inertia force, the PA collides with the inclined surfaces 61*a* and 61*b* of the first hopper 61 and easily flows out to the outside. However, since the PA flowing out to the outside collide with the first baffle plate 71 or the second baffle plate 72, outflow of the PA is blocked. As a result, it is possible to appropriately collect the PA in the flue gas in the first hopper 61, and it is possible to improve collection efficiency of the PA.

Figure 4:
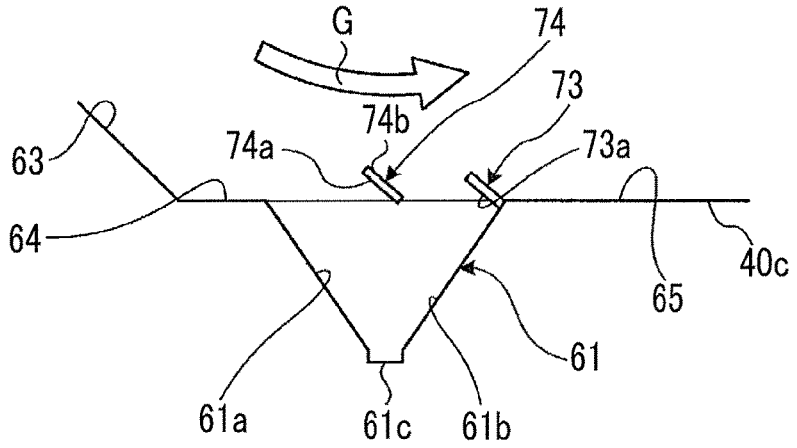
FIG. 4 is a schematic view showing a modification example of the exhaust duct.
Figure 5:
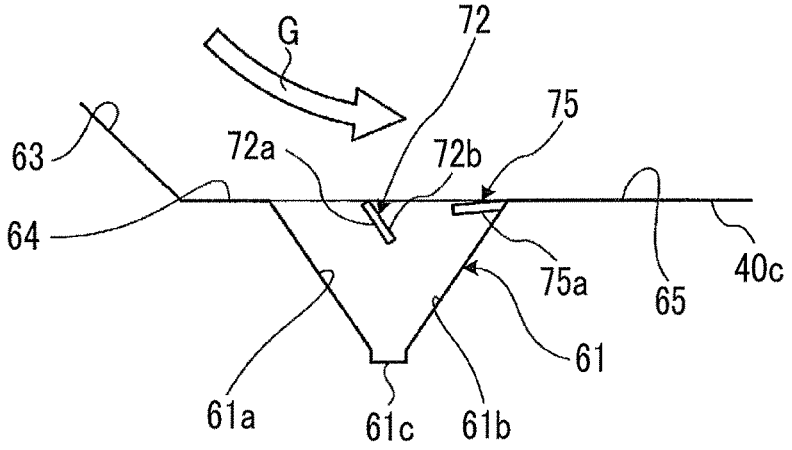
FIG. 5 is a schematic view showing a modification example of the exhaust duct.
Figure 6:
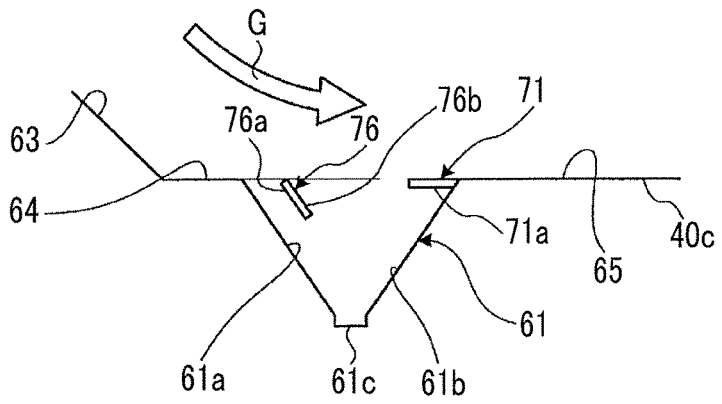
FIG. 6 is a schematic view showing a modification example of the exhaust duct.

In addition, in the exhaust duct of the present invention, each of the baffle plates (resisting members) 71 and 72 provided in the first hopper 61 is not limited the above-described shape, disposition, or the like. FIGS. 4 to 6 are schematic views showing modification examples of the exhaust duct.

As shown in FIG. 4, the resisting members of the present invention are constituted of a first baffle plate 73 and a second baffle plate 74. The first baffle plate 73 and the second baffle plate 74 are disposed on the upper portion of the first hopper 61 along the horizontal direction intersecting the flow direction of the flue gas. Each of the baffle plates 73 and 74 is disposed so as to protrude toward the flue gas passage in the second horizontal flue portion 40*c* from the inner portion of the first hopper 61.

The first baffle plate 73 is disposed on the upper portion of the first hopper 61 and the downstream side end portion in the flow direction of the flue gas. The first baffle plate 73 is fixed so as to be inclined by a predetermined angle in the vicinity of the upper opening edge E1 of the first hopper 61. Specifically, the first baffle plate 73 is disposed such that the lower end portion in the vertical direction is inclined by a predetermined angle toward the downstream side in the flow direction of the flue gas. In addition, in the first baffle plate 73, a collision surface 73*a* with respect to the solid particles is formed so as to face the flow direction of the flue gas, and the collision surface 73*a* faces the bottom portion (storage portion 61*c*) side of the first hopper 61.

The second baffle plate 74 is disposed on the upper portion of the first hopper 61 and at the intermediate position in the flow direction of the flue gas. The second baffle plate 74 is fixed so as to be inclined by a predetermined angle in the vicinity of the upper opening edge E1 of the first hopper 61. Specifically, the second baffle plate 74 is disposed such that the lower end portion in the vertical direction is inclined by a predetermined angle toward the downstream side in the flow direction of the flue gas. Moreover, in the second baffle plate 74, a first collision surface 74*a* with respect to the solid particles is formed so as to face the flow direction of the flue gas, and the first collision surface 74*a* faces the bottom portion (first inclined surface 61*a*) side of the first hopper 61. In addition, in the second baffle plate 74, a second collision surface 74*b* with respect to the solid particles which does not face the flow direction of the flue gas is formed, and the second collision surface 74*b* faces the downstream side in the flow direction of the flue gas on the upper portion of the first hopper 61.

The functions of the first baffle plate 73 and the second baffle plate 74 are approximately the same as those of the first baffle plate 71 and the second baffle plate 72. However, since both of the first baffle plate 73 and the second baffle plate 74 protrude from the first hopper 61 toward the flue gas passage in the second horizontal flue portion 40*c* and are inclined, the PA flowing along with the flue gas G easily collides with each of the baffle plates 73 and 74, and it is possible to efficiently block outflow of the PA from the first hopper 61.

In addition, as shown in FIG. 5, the resisting members of the present invention are constituted of a first baffle plate 75 and the second baffle plate 72. The first baffle plate 75 and the second baffle plate 72 are disposed on the upper portion of the first hopper 61 along the horizontal direction intersecting the flow direction of the flue gas. Each of the baffle plates 75 and 72 is disposed so as to not protrude toward the flue gas passage in the second horizontal flue portion 40*c* from the inner portion of the first hopper 61.

The first baffle plate 75 is disposed on the upper portion of the first hopper 61 and the downstream side end portion in the flow direction of the flue gas. The first baffle plate 75 is fixed so as to be inclined by a predetermined angle in the vicinity of the upper opening edge E1 of the first hopper 61. Specifically, the first baffle plate 75 is disposed such that the tip portion on the upstream side in the flow direction of the flue gas is inclined downward by a predetermined angle in the horizontal direction. In addition, in the first baffle plate 75, a collision surface 75*a* with respect to the solid particles is formed so as to face the flow direction of the flue gas, and the collision surface 75*a* faces the bottom portion (storage portion 61*c*) side of the first hopper 61. Moreover, the second baffle plate 72 is the same as the above-described plate.

The function of the first baffle plate 75 is substantially the same as that of the first baffle plate 71. However, the first baffle plate 75 is inclined downward, the PA entering the first hopper 61 easily collides with the first baffle plate 75, and it is possible to effectively block the outflow of the PA from the first hopper 61.

Moreover, as shown in FIG. 6, the resisting members of the present invention are constituted of the first baffle plate 71 and a second baffle plate 76. The first baffle plate 71 and the second baffle plate 76 are disposed on the upper portion of the first hopper 61 along the horizontal direction intersecting the flow direction of the flue gas. Each of the baffle plates 71 and 76 is disposed so as to not protrude toward the flue gas passage in the second horizontal flue portion 40*c* from the inner portion of the first hopper 61.

The first baffle plate 71 is the same as the above-described plate. The second baffle plate 76 is disposed on the upper portion of the first hopper 61 and the downstream side end portion in the flow direction of the flue gas. The second baffle plate 76 is fixed so as to be inclined by a predetermined angle in the vicinity of the upper opening edge E1 of the first hopper 61. Specifically, the second baffle plate 76 is disposed such that the lower end portion in the vertical direction is inclined by a predetermined angle toward the downstream side in the flow direction of the flue gas. In addition, in the second baffle plate 76, a first collision surface 76*a* with respect to the solid particles is formed so as to face the flow direction of the flue gas, and the first collision surface 76*a* faces the bottom portion (first inclined surface 61*a*) side of the first hopper 61. In addition, in the second baffle plate 76, a second collision surface 76*b* with respect to the solid particles which does not face the flow direction of the flue gas is formed, and the second collision surface 76*b* faces the downstream side in the flow direction of the flue gas on the upper portion of the first hopper 61.

The function of the second baffle plate 76 is approximately the same as that of the second baffle plate 72. However, since the second baffle plate 76 is disposed on the upstream side in the flow direction of the flue gas in the first hopper 61, the PA1 falling along the inclined inner wall surface 63 easily collides with the second baffle plate 76, and it is possible to effectively block the outflow of the PA from the first hopper 61. In this case, the second baffle plate 76 may be disposed so as to protrude from the inner portion of the first hopper 61 toward the flue gas passage in the second horizontal flue portion 40*c*.

Moreover, here, the plurality of baffle plates 71, 72, 73, 74, 75, and 76 are described. However, combination of the baffle plates 71, 72, 73, 74, 75, and 76 is not limited to the embodiment, and the baffle plates may be appropriately combined to each other. In addition, the number of the baffle plates 71, 72, 73, 74, 75, and 76 which are mounted in the first hopper 61 is not limited to two, and may be one or three or more.

[Second Embodiment]

Figure 7:
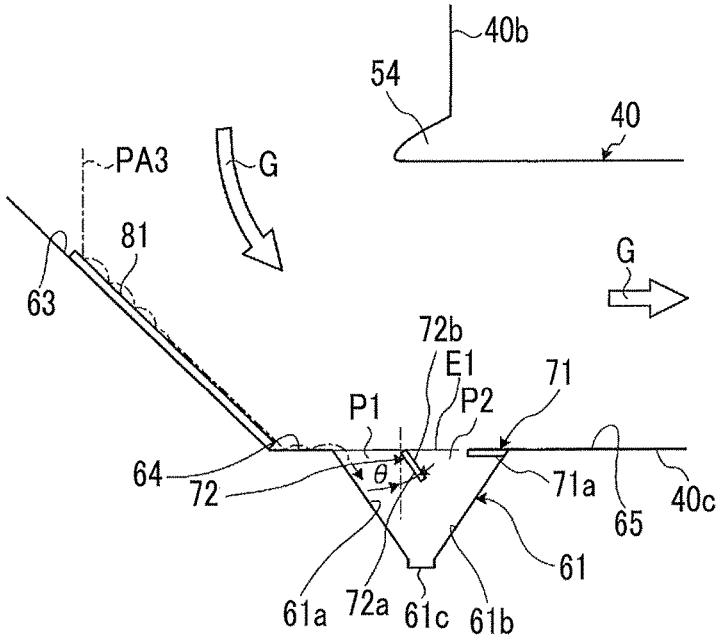
FIG. 7 is a side view showing an exhaust duct of a second embodiment.
Figure 8:
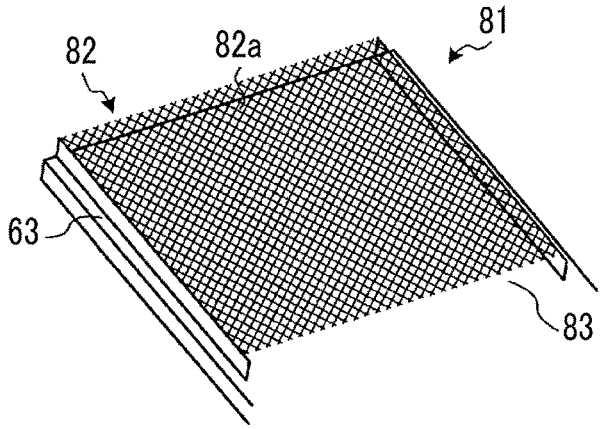
FIG. 8 is a perspective view showing a low repulsion structure portion which is provided in the exhaust duct.
Figure 9:
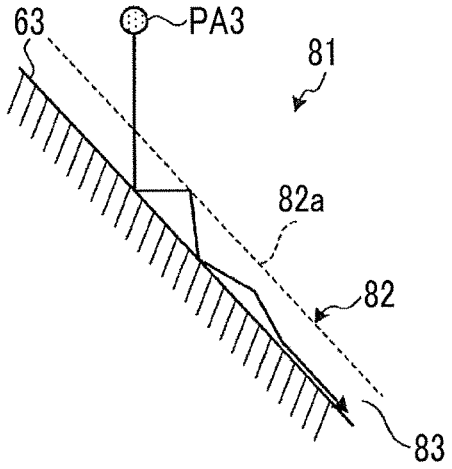
FIG. 9 is a schematic view showing effects of the low repulsion structure portion.
Figure 10:
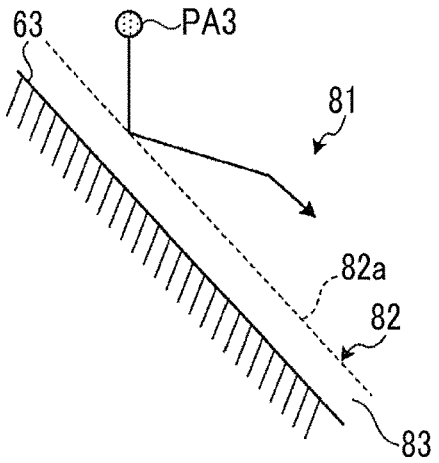
FIG. 10 is a schematic view showing effects of the low repulsion structure portion.

FIG. 7 is a side view showing an exhaust duct of a second embodiment, FIG. 8 is a perspective view showing a low repulsion structure portion which is provided in the exhaust duct, and FIGS. 9 and 10 are schematic views showing effects of the low repulsion structure portion. In addition, the same reference numerals are assigned to the members having the same functions as those of the above-described embodiment, and detail descriptions thereof are omitted.

In the second embodiment, as shown in FIGS. 6 and 7, the exhaust duct includes the flue (flue gas passage) 40 in which the flue gas can flow, the first hopper 61 which is provided in the flue 40 and can collect the PA in the flue gas, and the first baffle plate 71 and the second baffle plate 72 which are the resisting members which can block outflow of the PA from the first hopper 61, and a low repulsion portion 81 which is provided on the upstream side of the first hopper 61 in the flow direction of the flue gas and has a lower repulsion coefficient than that of the inner wall surface of the flue 40.

The first baffle plate 71 and the second baffle plate 72 are approximately the same as those of the first embodiment, and are disposed on the upper portion of the first hopper 61 along the horizontal direction intersecting the flow direction of the flue gas. The first baffle plate 71 is disposed on the upper portion of the first hopper 61 and is disposed so as to be horizontal to the downstream side end portion in the flow direction of the flue gas. The second baffle plate 72 is disposed on the upper portion of the first hopper 61 and at the intermediate position in the flow direction of the flue gas. The second baffle plate 72 is fixed so as to be inclined downward by a predetermined angle in the vicinity of the upper opening edge E1 of the first hopper 61.

In flue 40, the inclined inner wall surface 63 is provided, and the angle of the inclined inner wall surface 63 is set so as to be equal to or more than a repose angle at which the PA falls. The low repulsion portion 81 is fixed to the inclined inner wall surface 63, and in order to improve collection efficiency of the PA in the first hopper 61, the low repulsion portion 81 is constituted of a member having a smaller repulsion coefficient than that of the inclined inner wall surface 63 (for example, steel plate). Accordingly, when the PA falls along the inclined inner wall surface 63, the PA falls while coming into contact with the low repulsion portion 81. Therefore, when the PA collides with the low repulsion portion 81, a repulsion amount of the PA decreases.

As a result, since PA3 falling along with the downward flow of the flue gas is repelled so as to be lower than the repulsion amount when the PA directly collides with the inclined inner wall surface 63 of the related art which is a steel plate, a probability of the PA3 jumping over the first hopper 61 and being scattered to reach the second horizontal inner wall surface 65 decreases, and the collection efficiency of the PA in the first hopper 61 is improved.

Here, a specific configuration example of the above-described low repulsion portion 81 will be described with reference to the drawings. As shown in FIG. 8, in the low repulsion portion 81, a wiring netting (low repulsion portion formation member) 82 is disposed on the inclined inner wall surface 63 of the steel plate duct so as to provide a space portion 83 therebetween. A plurality of opening portions 82*a* serving as the passage of the PA are provided in the wiring netting 82. Accordingly, as shown in FIG. 9, the PA passing through the opening portion 82*a* of the wiring netting 82 collides with the inclined inner wall surface 63 and is repelled. However, thereafter, the PA is likely to collide with the back face side of the wiring netting 82 again. As a result, the PA colliding with the back face side of the wiring netting 82 falls in the space portion 83 along the inclined inner wall surface 63, and finally, the PA is collected in the first hopper 61.

Meanwhile, all PA does not pass through the opening portion 82*a* of the wiring netting 82, and some PA may collide with the wiring netting 82 in which linear members are combined in a lattice shape. As shown in FIG. 10, the PA colliding with the linear members of the wiring netting 82 collides with the member which generally has a lower repulsion coefficient than that of a steel plate and is easily elastically deformed, and a result, the PA is likely to be collected in the first hopper 61 due to a decrease of the repulsion amount. In this way, in the above-described low repulsion portion 81, since it is possible to efficiently collect the PA passing through the opening portion 82*a* of the wiring netting 82 and the PA colliding with the wiring netting 82 in the first hopper 61, collection efficiency of the PA in the first hopper 61 is effectively improved.

In addition, the low repulsion portion 81 is the wiring netting 82. However, the present invention is not limited to this configuration. As the low repulsion portion, in addition to the wiring netting 82, for example, a lattice-shaped member such as a grating, a porous plate, or a bamboo blind structure (slatted shutter) may be used, which includes a plurality of opening portions having sizes in which the PA can pass through. Particularly, like the linear member of the wiring netting 82, if the lattice-shaped low repulsion member formed of a material which collides with the PA and is elastically deformed is adopted, collision energy of the PA due to elastic deformation is effectively absorbed, and it is possible to decrease the repulsion amount. In addition, due to rotation of the collided PA, the repulsion amount can be decreased. In addition, as the low repulsion portion 81, a heat insulation material, a rubber material, a plastic material, or the like may be adopted.

In this way, in the exhaust duct of the second embodiment, the low repulsion portion 81 having a lower repulsion coefficient than that of the inclined inner wall surface 63 is provided on the downstream side of the first hopper 61 in the flow direction of the flue gas G. Accordingly, since the repulsion amount decreases after the PA included in the flue gas G collides with the low repulsion portion 81, it is possible to appropriately collect the PA in the first hopper 61. In this case, since the low repulsion portion 81 is positioned on the upstream side in the flow direction of the flue gas G in the first hopper 61, the PA collides with the low repulsion portion 81 before the first hopper 61, the inertia force of the PA decreases, and the PA easily enters the first hopper 61. Accordingly, the amount of the PA which jumps over the first hopper 61, is scattered toward the downstream side, and flows to the outside decreases.

[Third Embodiment]

Figure 11:
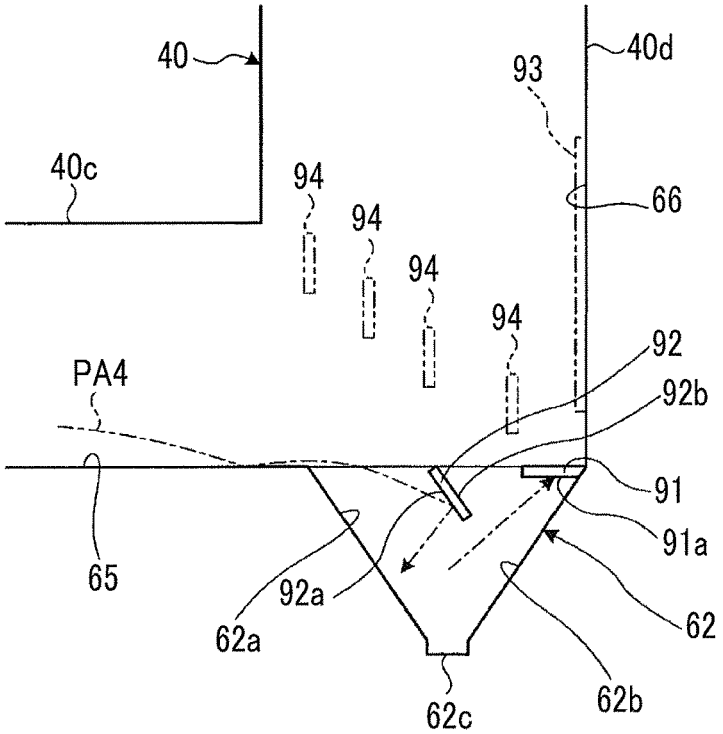
FIG. 11 is a side view showing an exhaust duct of a third embodiment.

FIG. 11 is a side view showing an exhaust duct of a third embodiment. In addition, the same reference numerals are assigned to the members having the same functions as those of the above-described embodiments, and detail descriptions thereof are omitted.

As shown in FIG. 11, in the third embodiment, a first baffle plate 91 and a second baffle plate 92 are provided in the second hopper 62 as the resisting members. That is, the second hopper 62 includes a first inclined surface 62*a* and a second inclined surface 62*b* which face each other in the flow direction of the flue gas such that an area of the second hopper 62 decreases downward, and a storage portion 62*c* is provided on a bottom position at which the lower end portions of the inclined surfaces 62*a* and 62*b* are connected to each other. In addition, in the second hopper 62, an opening portion which can be opened and closed by an on-off valve (not shown) is provided in the storage portion 62*c*, and the stored PA can be discharged downward by opening the opening portion.

In addition, in the flue 40, the second hopper 62 is provided in the second horizontal flue portion 40*c*, the second horizontal inner wall surface 65 continuously provided on the upstream side of the second hopper 62 in the flow direction of the flue gas, and a vertical inner wall surface 66 is provided on the downstream side of the second hopper 62 in the flow direction of the flue gas. Moreover, the second horizontal inner wall surface 65 is continuous to the first inclined surface 62*a*, and the vertical inner wall surface 66 is continuous to the second inclined surface 62*b*.

The first baffle plate 91 and the second baffle plate 92 are disposed on the upper portion of the second hopper 62 along the horizontal direction (a direction vertical to a paper surface of FIG. 11) intersecting the flow direction of the flue gas. The first baffle plate 91 is disposed on the upper portion of the second hopper 62 and on the downstream side end portion in the flow direction of the flue gas. The first baffle plate 91 is fixed to the second hopper 62 so as to be horizontal along the upper opening edge of the second hopper 62. The second baffle plate 92 is disposed on the upper portion of the second hopper 62 and at the intermediate position in the flow direction of the flue gas. The second baffle plate 92 is fixed so as to be inclined by a predetermined angle in the vicinity of the upper opening edge of the second hopper 62. The configurations of the first baffle plate 91 and the second baffle plate 92 are similar to those of the first baffle plate 71 and the second baffle plate 72 which are described in the first embodiment.

Accordingly, the flue gas horizontally flows through the second horizontal flue portion 40*c*, is curved so as to be approximately perpendicular to the second horizontal flue portion 40*c*, and rises along the second vertical flue portion 40*d*. As this time, the PA contained in the flue gas freely falls in the second hopper 62 so as to be stored.

For example, the PA flowing along the second horizontal inner wall surface 65 enters the second hopper 62 so as to be collected. At this time, the PA entering the second hopper 62 collides with the inclined surfaces 62*a* and 62*b*, and there is a concern that the PA may be out of the second hopper 62 due to the repulsion force. However, in the present embodiment, since the second baffle plate 92 is provided, when the PA enters the second hopper 62, the PA collides with a first collision surface 92*a* of the second baffle plate 92 and moves to the storage portion 62*c* side so as to be collected, and outflow of the PA from the second hopper 62 is blocked.

In addition, PA4 directly entering the second hopper 62 collides with a second collision surface 92*b* of the second baffle plate 92, moves toward the second inclined surface 62*b* side, collides with the second inclined surface 62*b*, and thereafter, is discharged to the outside. However, since the PA4 collides with the collision surface 91*a* of the first baffle plate 91 and moves toward the storage portion 62*c* side so as to be collected, the outflow of the PA from the second hopper 62 is blocked. In addition, after the PA4 directly entering the second hopper 62 collides with each of the inclined surfaces 62*a* and 62*b*, the PA4 collides with each of the collision surfaces 91*a* and 92*a* of the baffle plates 91 and 92 and moves toward the storage portion 62*c* side so as to be collected. Accordingly, the outflow of the PA from the second hopper 62 is blocked.

In the way, in the exhaust duct of the third embodiment, the flue 40 in which the flue gas can flow, the second hopper 62 which is provided in the flue 40 and can collect solid particles (PA) in the flue gas, and the first baffle plate 91 and the second baffle plate 92 which are the resisting members which can block outflow of the PA from the second hopper 62 are provided.

Accordingly, when the flue gas containing the PA flows through the flue 40, the PA is separated from the flue gas so as to be collected in the second hopper 62. At this time, since the PA has an inertial force, the PA collides with the inclined surfaces 62*a* and 62*b* of the second hopper 62, is repelled, and easily flows out. However, since the PA flowing to the outside collides with the first baffle plate 91 or the second baffle plate 92, outflow of the PA is blocked. As a result, it is possible to appropriately collect the PA in the flue gas in the second hopper 62, and it is possible to improve collection efficiency of the PA.

Moreover, similarly to the second embodiment, in the third embodiment, the low repulsion portion having a lower repulsion coefficient than that of the inner wall surface of the flue 40 may be provided on the downstream side of the second hopper 62 in the flow direction of the flue gas.

For example, a low repulsion portion 93 is provided on the vertical inner wall surface 66 which collides with the PA on the downstream side of the second hopper 62. According to the low repulsion portion 93, most of the PA included in the flue gas collides with the low repulsion portion 93 due to the inertial force. In the PA which is repelled by the collision, the repulsion coefficient decreases, and a ratio of the PA reaching the center of the channel section in which a flow rate is high and the vicinity thereof decreases. Accordingly, the second hopper 62 falls so as to be collected, and the collection efficiency of the PA is improved.

A plurality of low repulsion portions 94 are provided on the channel portion which is positioned on the downstream side of the second hopper 62. For example, the low repulsion portion 94 has a bamboo blind structure which is constituted of a plurality of surfaces facing the air flow in the horizontal direction, the speed of the PA colliding with the surface of the bamboo blind structure decreases, and the PA falls in the second hopper 62 so as to be collected. The collection efficiency of the PA is improved.

In addition, in the above-described embodiment, the case where the exhaust duct of the present invention is applied to the pulverized coal burning boiler is described. However, the present invention is not limited this type of boiler. In addition, the present invention is not limited to the boiler, and the present invention may be applied to any exhaust duct as long as the flue gas including the solid particles can flow to it.

REFERENCE SIGNS LIST

10: pulverized coal burning boiler
11: furnace
21, 22, 23, 24, 25: combustion burner
40: flue (flue gas passage)
41, 42: superheater (heat collection portion)
43, 44: reheater (heat collection portion)
45, 46, 47: economizer (heat collection portion)
61: first hopper
62: second hopper
63: inclined inner wall surface
64: first horizontal inner wall surface
65: second horizontal inner wall surface
71, 73, 75, 91: first baffle plate
71*a*, 73*a*, 75*a*: collision surface
72, 74, 76, 92: second baffle plate
72*a*, 74*a*, 76*a*: first collision surface
72*b*, 74*b*, 76*b*: second collision surface
81, 93, 94: low repulsion portion

The invention claimed is:

1. An exhaust duct comprising:

a flue gas passage in which flue gas can flow;

a hopper which is provided in the flue gas passage and can collect solid particles in the flue gas; and resisting members which can block outflow of the solid particles from the hopper, wherein the resisting members include a baffle plate which is disposed on an upper portion of the hopper along a horizontal direction intersecting a flow direction of the flue gas, wherein the baffle plate includes a first baffle plate which is disposed on the upper portion of the hopper and a downstream side end portion in the flow direction of the flue gas, and a second baffle plate which is disposed on the upper portion of the hopper and at an intermediate position in the flow direction of the flue gas, and wherein the second baffle plate is disposed such that a lower end portion in a vertical direction is inclined toward the downstream side in the flow direction of the flue gas, and the second baffle plate is disposed above a storage portion of the hopper.

2. The exhaust duct according to claim 1, wherein a collision surface of the first baffle plate with respect to the solid particles facing the flow direction of the flue gas is disposed so as to be toward a bottom portion side of the hopper.

3. The exhaust duct according to claim 1, wherein the hopper is formed so as to be concaved from the flue gas passage toward the lower side in the vertical direction, and the resisting members are disposed so as not to protrude toward the flue gas passage in the hopper.

4. The exhaust duct according to claim 1, wherein a low repulsion portion having a lower repulsion coefficient than that of an inner wall surface of the flue gas passage is provided on an upstream side or a downstream side of the hopper in the flow direction of the flue gas.

5. A boiler comprising:

a furnace which has a hollow shape and is provided along a vertical direction;

a combustion device which blows a fuel toward the inner portion of the furnace and combusts the fuel;

the exhaust duct according to claim 1 which is connected to a downstream side in a flow direction of a flue gas in the furnace; and a heat collection portion which is provided in the exhaust duct and can collect heat in the flue gas.

* * * * *